US011162336B1

(12) United States Patent
Perez

(10) Patent No.: US 11,162,336 B1
(45) Date of Patent: Nov. 2, 2021

(54) VALVE COMPONENT INCLUDING INCLINED AND/OR CURVED SEATING ELEMENT

(71) Applicant: Juan Carlos Flores Perez, The Woodlands, TX (US)

(72) Inventor: Juan Carlos Flores Perez, The Woodlands, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 16/918,497

(22) Filed: Jul. 1, 2020

(51) Int. Cl.

| | |
|---|---|
| ***E21B 34/10*** | (2006.01) |
| ***E21B 34/14*** | (2006.01) |
| ***E21B 43/12*** | (2006.01) |
| ***E21B 43/25*** | (2006.01) |

(52) U.S. Cl.
CPC ..... *E21B 43/121* (2013.01); *E21B 34/14* (2013.01); *E21B 34/10* (2013.01); *E21B 2200/02* (2020.05)

(58) Field of Classification Search
CPC ..... E21B 34/10; E21B 34/14; E21B 43/121; E21B 43/25; E21B 2200/02
See application file for complete search history.

(56) References Cited

U.S. PATENT DOCUMENTS 2,956,582 A * 10/1960 Pranter ..... F16K 15/038 137/512.1
4,067,540 A * 1/1978 Slade ..... E21B 21/10 251/212
5,044,396 A * 9/1991 Daudet ..... F16K 15/03 137/515.5
5,145,005 A * 9/1992 Dollison ..... E21B 34/12 166/332.8
7,537,062 B2 * 5/2009 Hughes ..... E21B 34/06 166/386
7,708,066 B2 * 5/2010 Frazier ..... E21B 34/14 166/250.08
8,151,889 B2 * 4/2012 Biddick ..... E21B 34/14 166/332.8
8,739,881 B2 * 6/2014 Frazier ..... E21B 43/25 166/332.8
9,562,418 B2 * 2/2017 Osborne ..... E21B 34/08
9,624,746 B2 * 4/2017 Hendel ..... E21B 34/08
2002/0007950 A1 * 1/2002 Simpson ..... E21B 34/06 166/332.2
2005/0252660 A1 * 11/2005 Hughes ..... E21B 34/12 166/334.2

* cited by examiner

*Primary Examiner* — Matthew R Buck
(74) *Attorney, Agent, or Firm* — Cantor Colburn LLP

(57) ABSTRACT

A device for controlling fluid flow in a borehole includes a support structure including a fluid conduit, the fluid conduit defining a flow path having a longitudinal axis, and a valve seat connected to the support structure and disposed within the fluid conduit. The valve seat defines a first engagement surface and has an opening configured to permit fluid flow through the fluid conduit, the first engagement surface having an inclined shape, the inclined shape defining an angle with respect to the longitudinal axis. The device also includes a valve member disposed within the fluid conduit, the valve member configured to be actuated to move the valve member between an open position and a closed position, the valve member engaging the first engagement surface to restrict the fluid flow when in the closed position.

20 Claims, 7 Drawing Sheets

VALVE COMPONENT INCLUDING INCLINED AND/OR CURVED SEATING ELEMENT

BACKGROUND

There are a variety of tools and components that are deployed downhole to facilitate exploration and/or production of hydrocarbons. Such components can include fluid control devices and systems for regulating or controlling the flow of fluid in a borehole, at least some of which include valve components that can be actuated to restrict the flow of fluid for purposes such as zone isolation, control of injected fluids, bypass and hydraulic actuation. Examples of tools or components that utilize valve components include plugs (e.g., frac plugs and bridge plugs), safety valves, inflow control valves and inflow control devices.

SUMMARY

An embodiment of a device for controlling fluid flow in a borehole includes a support structure including a fluid conduit, the fluid conduit defining a flow path having a longitudinal axis, and a valve seat connected to the support structure and disposed within the fluid conduit. The valve seat defines a first engagement surface and has an opening configured to permit fluid flow through the fluid conduit, the first engagement surface having an inclined shape, the inclined shape defining an angle with respect to the longitudinal axis. The device also includes a valve member disposed within the fluid conduit, the valve member configured to be actuated to move the valve member between an open position and a closed position, the valve member engaging the first engagement surface to restrict the fluid flow when in the closed position.

An embodiment of a method of controlling fluid flow in a borehole includes deploying a fluid control device in a borehole, the fluid control device including a support structure having a fluid conduit that defines a flow path having a longitudinal axis, a valve seat disposed within the fluid conduit and connected to the support structure, and a valve member disposed within the fluid conduit and configured to be actuated to move the valve member between an open position and a closed position. The valve seat defines a first engagement surface and having an opening configured to permit fluid flow through the fluid conduit, the first engagement surface having an inclined shape, the inclined shape defining an angle with respect to the longitudinal axis. The method also includes controlling fluid flow through the fluid conduit by moving the valve member from the open position to the closed position and engaging the valve member with the first engagement surface to restrict the fluid flow.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method presented herein by way of exemplification and not limitation with reference to the figures.

Systems, devices and methods are provided herein for control of fluid in a borehole in a subterranean region, such as a hydrocarbon bearing (or potentially hydrocarbon bearing) formation. An embodiment of a fluid control device, such as a fracturing ("frac") plug, includes a mandrel or other support structure that defines a fluid conduit and a valve assembly in fluid communication with the fluid conduit. The valve assembly includes a valve seat and moveable valve member (e.g., a flapper). The valve seat includes or defines a curved and/or inclined surface that is engageable by the valve member to restrict or prevent fluid flow through the valve assembly. The curved and/or inclined engagement surface provides for an increased surface area of the engagement surface as compared to conventional downhole valves, which allows for higher fluid pressures to be exerted on the valve assembly when closed.

In one embodiment, the valve seat is a stationary component that is fixedly positioned relative to the support structure. The valve member may be moved similar to a flapper valve, and may be configured so that the valve member defines a curved and/or inclined surface that is exposed to fluid flow when closed, to further increase the amount of fluid pressure that can be withstood. In one embodiment, the valve seat and the valve member are both moveable to close the valve assembly, and may define a dome shaped or conical surface that is exposed to fluid flow when closed.

Embodiments described herein provide a number of advantages and technical effects. The valve assemblies described herein are capable of effectively restricting fluid flow at high pressures using a downhole valve seat and valve member in tools or components that have restricted sizes and internal diameters. Due to the limited available space in fluid control devices such as frac plugs and bridge plugs, it can be challenging to design a valve assembly that can withstand high downhole pressures. Conventional approaches utilize ball seat assemblies in which a ball or other object is dropped downhole to a ball seat. The embodiments described herein provide an effective alternative in the form of a valve assembly such as a flapper valve that has a pressure rating that exceeds conventional flapper valves. Another advantage is that conventional flat flappers typically require some sort of mechanical reinforcement, which is not needed in the embodiments described herein.

Figure 1:
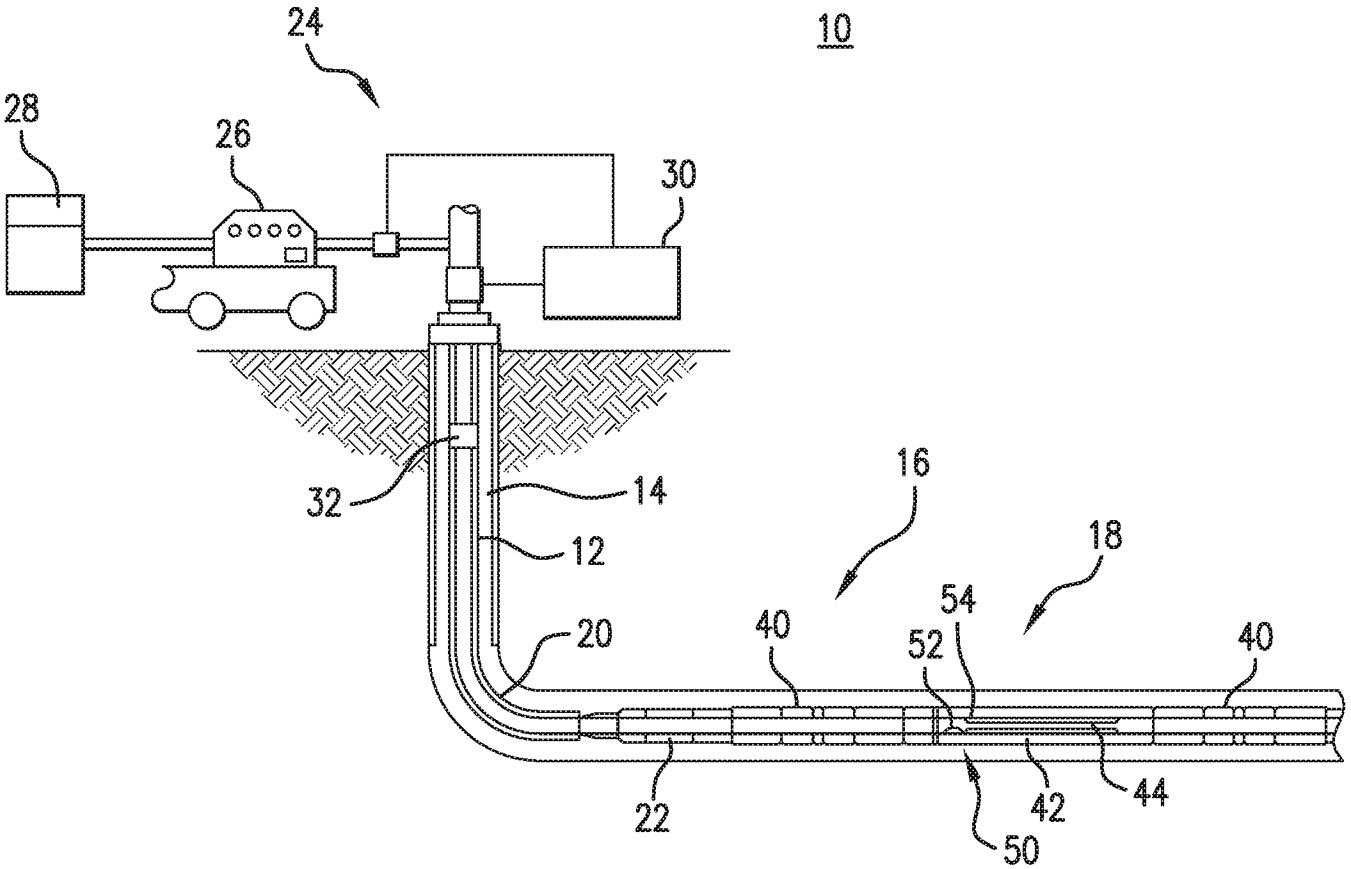
FIG. 1 illustrates an embodiment of a system for performing energy industry and/or subterranean operations, the system including a valve assembly.

FIG. 1 illustrates an embodiment of a system 10 for performing subterranean operations and/or energy industry operations, such as a completion and hydrocarbon production system 10. The system 10 includes a borehole string 12 that is configured to be disposed in a borehole 14 that penetrates a resource bearing formation 16 or other subterranean region. The borehole string 12 includes various components to facilitate drilling, exploration, stimulation, measurement, production and/or other functions.

In one embodiment, the borehole string 12 includes a stimulation and/or completion assembly 18 that is deployed into the borehole 14 using a running string 20. The running string may be made from any of a variety of components, such as a wireline or coiled tubing. The running string 20 may include or be attached to a running tool 22 for deployment of the stimulation and/or completion assembly 18.

The system 10 also includes surface equipment 24 such as a drill rig, rotary table, top drive, blowout preventer and/or others to facilitate deploying the stimulation and/or completion assembly 18 and/or controlling downhole components. For example, the surface equipment 24 includes a fluid control system 26 including one or more pumps in fluid communication with a fluid tank 28 or other fluid source.

In one embodiment, the system 10 includes a processing device such as a surface processing unit 30, and/or a subsurface processing unit 32 disposed in the borehole 14 and connected to one or more downhole components. The surface processing unit 30 includes components such as a processor, an input/output device and a data storage device (or a computer-readable medium). The processing device may be configured to perform functions such as controlling downhole components, controlling fluid circulation, monitoring components during deployment, transmitting and receiving data, processing measurement data and/or monitoring operations. For example, the storage device stores processing modules for performing one or more of the above functions.

The stimulation and/or completion assembly 18 includes one or more packer assemblies 40 and a plug or other fluid control device, such as a fracturing or "frac" plug 42. In one embodiment, the frac plug 42 includes a restriction 44 in the form of a central bore. The restriction 44 in this embodiment is a fluid conduit that has a smaller diameter than other fluid conduits in the borehole string 12 (e.g., fluid conduits through the running string 20 and/or the packer assemblies 40. The frac plug 42 also includes a valve assembly 50 having a valve member 52 and a valve seat 54. The frac plug 42 is used to temporarily cut off fluid flow to allow for, e.g., pressurization sufficient to fracture a formation.

In one embodiment, the valve seat 54 and/or the valve member 52 have inclined and/or curved surfaces. As discussed further below, the inclined and/or curved surfaces provide an increased surface area of the valve seat 54 when compared to conventional valve assemblies. This increased surface area provides a higher pressure rating than conventional flapper valves. The valve seat 54 and the valve member 52 can be configured in a variety of ways. For example, as shown in FIG. 1, the valve seat 54 and the valve member 52 are both disposed within and entirely surrounded by the fluid conduit defined by the frac plug 42. In another example, the valve seat 54 and the valve member 52 can both be disposed within and entirely surrounded by the restriction 44.

Figure 2:
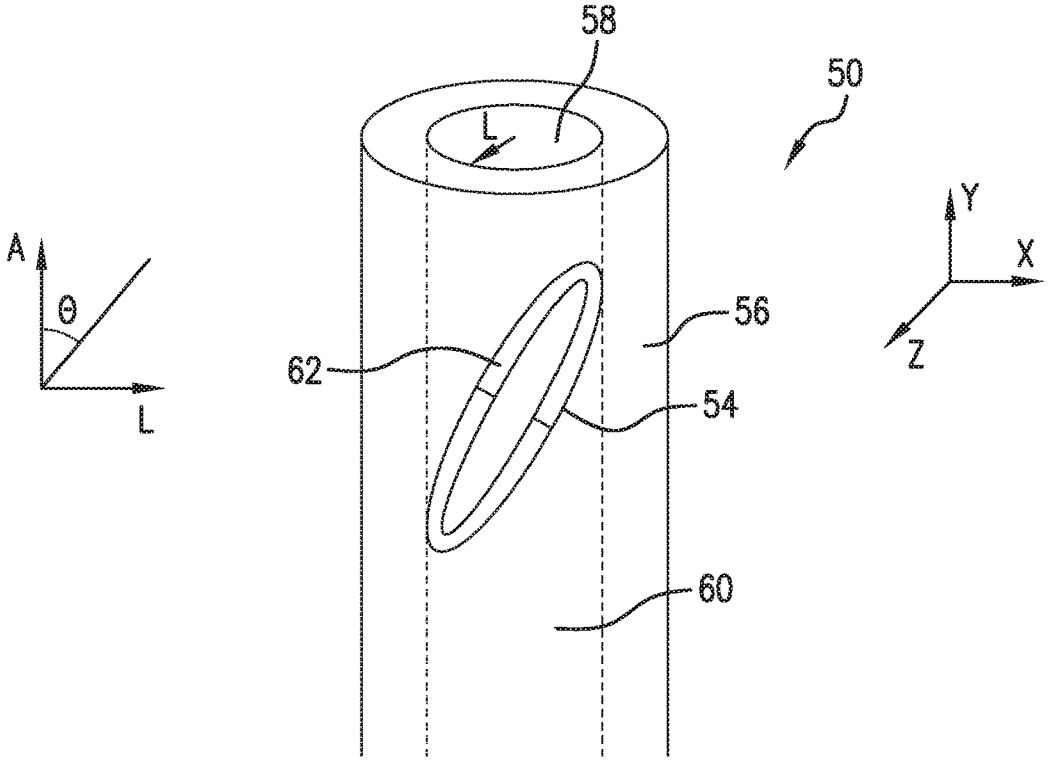
FIG. 2 depicts an embodiment of a valve assembly including an inclined valve seat.
Figure 3:
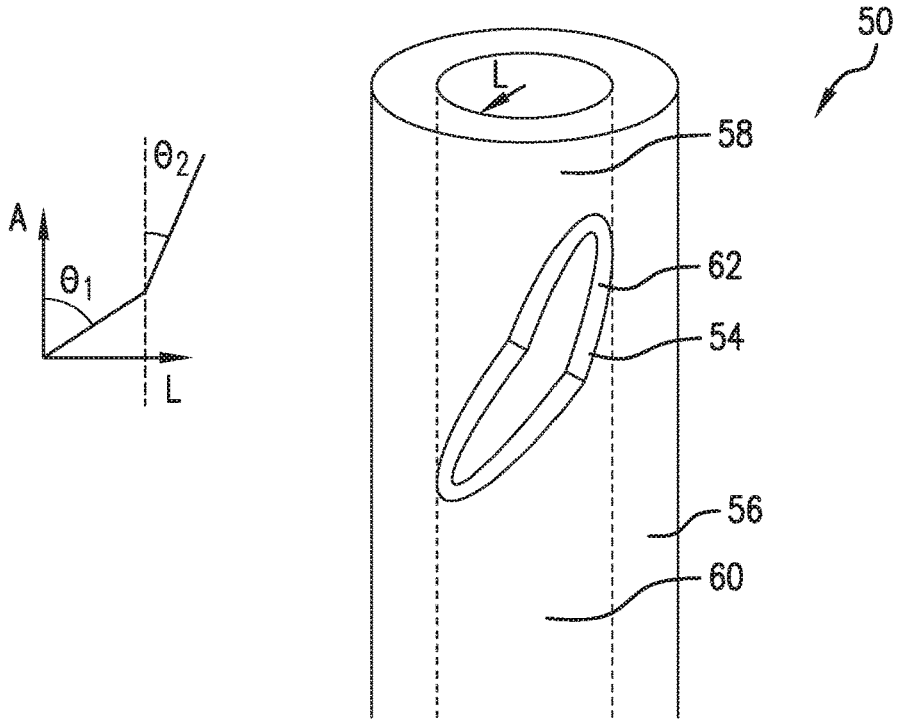
FIG. 3 depicts an embodiment of a valve assembly including an inclined valve seat.
Figure 4:
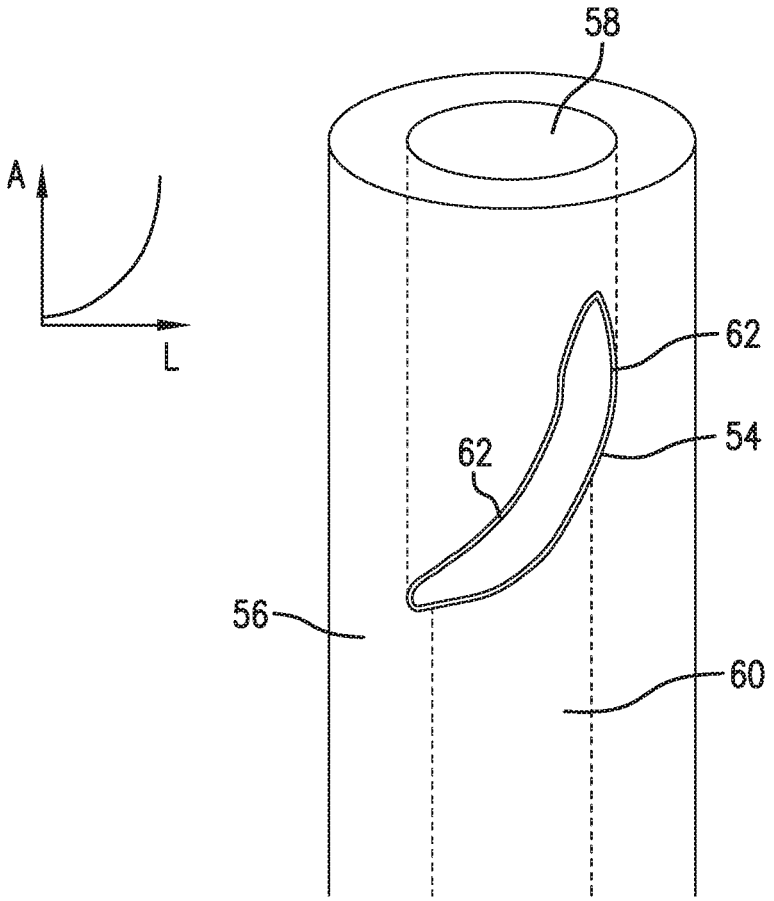
FIG. 4 depicts an embodiment of a valve assembly including an inclined and curved valve seat.

FIGS. 2-4 depict a number of examples of valve seats 54 having different inclined and/or curved surfaces. In these examples, the valve assembly 50 includes a mandrel 56 or other support structure. The mandrel 56 defines a fluid conduit that provides an axial flow path that follows an axial direction through the valve assembly 50. As described herein, an "axial direction" is a direction at least partially parallel to a longitudinal axis A of the valve assembly 50, the borehole string 12 and/or the borehole 14. As shown in FIG. 2, the longitudinal axis A is orthogonal to a radial or lateral axis L.

In these examples, the fluid conduit includes two sections, i.e., a first conduit section 58 and a second or restricted conduit section (restriction) 60 that defines a smaller flow area than the first conduit section. The first conduit section 58 is in fluid communication with the running string 20, the running tool 22 and/or other components of the borehole string 12 so that fluid can be injected from the surface to the valve assembly 50.

The valve seat 54 includes an engagement surface 62, which is inclined relative to the longitudinal axis L. In other words, the engagement surface 62 follows a linear path that defines an angle θ relative to the longitudinal axis A. The angle θ in this example is an acute angle. Any suitable angle θ may be selected based on considerations such as expected pressure and temperature, desired pressure rating, and available space within the mandrel 56. For example, the angle θ can be selected to be about 45 degrees, or within a range of a selected angle (e.g., plus or minus about 15 degrees).

As shown in FIG. 2, the angle θ may be defined in terms of a plane that is orthogonal to the longitudinal axis A. For example, the valve assembly 50 is shown in a three-dimensional coordinate space (x,y,z). The angle θ is shown in a plane (referred to as the A-L plane) defined by the longitudinal axis A, and the lateral axis L that extends radially outwardly from the center of the mandrel 56.

The engagement surface 62 may be a linear surface (i.e., following a linear path in the A-L plane) as shown in FIG. 2, but is not so limited. The engagement surface 62 may be a linear surface, a combination of linear surfaces, a curved surface or a combination of linear and curved surfaces.

As shown in FIG. 3, the engagement surface 62 may define a path in the A-L plane that defines multiple angles relative to the longitudinal axis A. For example, the path defined by the engagement surface 62 defines a first constituent path defining a first angle $\theta_1$, and a second constituent path defining a different second angle $\theta_2$.

FIG. 4 depicts an example of a valve seat that includes or defines a non-linear surface. In this example, the engagement surface defines a curved path in the A-L plane.

In the examples and embodiments described herein, the engagement surface 62 is an annular or semi-annular surface. For example, in FIG. 2, the engagement surface 62 is an annular surface that traverses entirely around the fluid conduit, e.g., around the first conduit 58 and/or the restriction 60. In other embodiments, the engagement surface 62 traverses entirely around the fluid conduit, with the exception of a portion of the valve seat 54 that is connected to the valve member (e.g., a hinge or pivot point). In still other embodiments, the surface 62 may be semi-annular, i.e., only partially surrounding the fluid conduit.

The valve seat 54 may be integral with the mandrel 56 or configured as a separate component that is attached to the mandrel 54. For example, the engagement surface 62 can be a shoulder or other feature that protrudes radially inwardly into the fluid conduit, or can be an insert, such as a tubular insert that is attached to the restriction 60 or forms at least part of the restriction 60.

As shown in the following embodiments, the valve member 52 is moveable between various positions. Such positions may include a "closed" position, an "open" position, and/or one or more intermediate positions between the closed and open positions. In the open position, the valve member 52 is not engaged is positioned so that fluid can flow substantially unobstructed through the mandrel 56. In the closed position, the valve member 52 is engaged with the valve seat 54 and obstructs fluid flow. Fluid flow may be completely obstructed, where the valve member 52 in the closed position contacts or otherwise engages the engagement surface 62 of the valve seat 54.

Figure 5A:
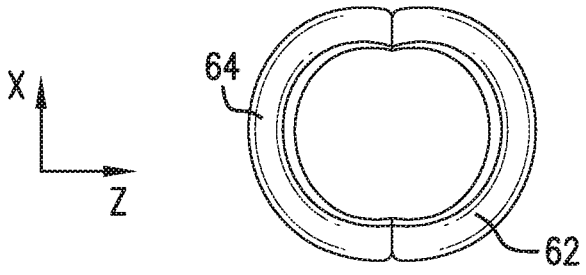
FIGS. 5A and 5B (collectively referred to as "FIG. 5") depict an axial view and a side view, respectively, of an embodiment of a valve assembly in an open position.
Figure 5B:
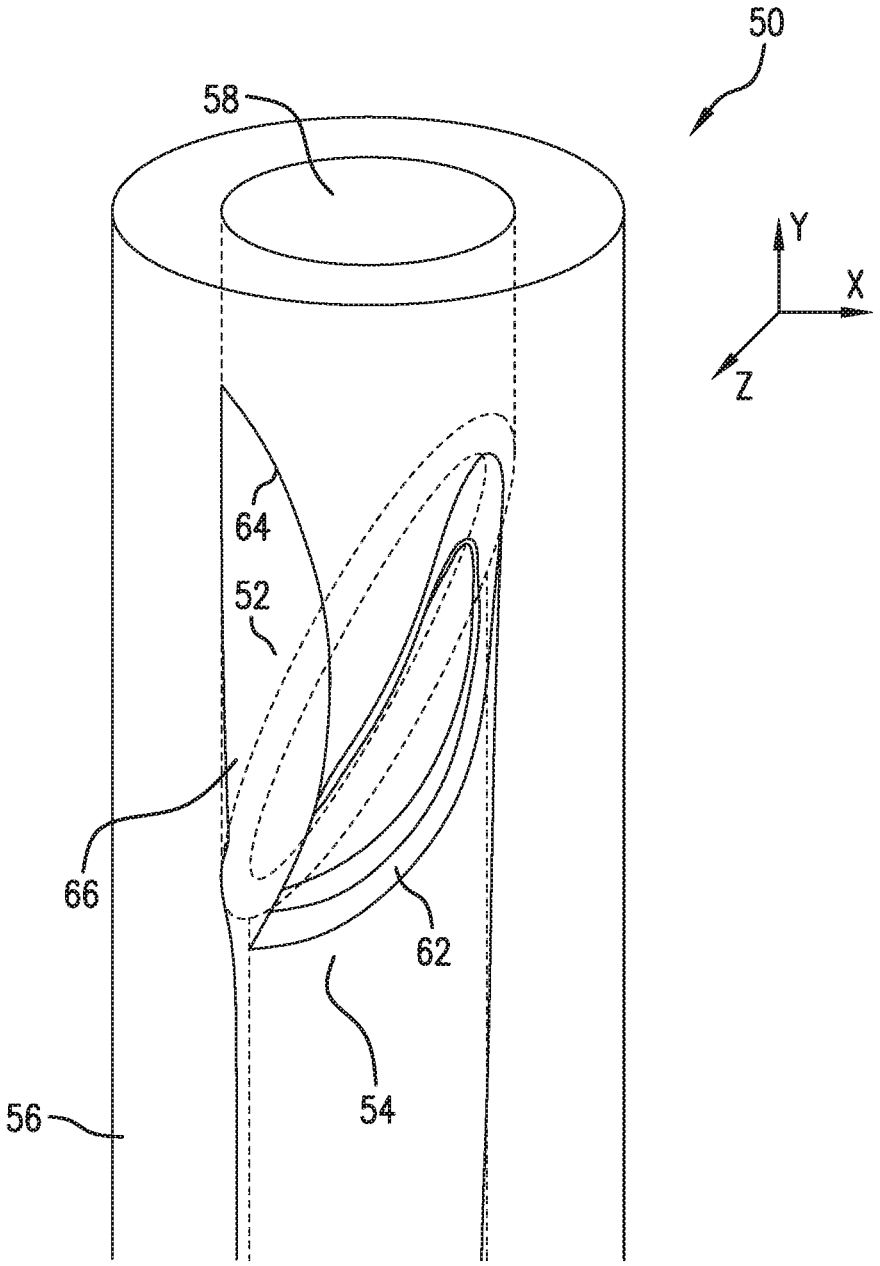
Figures 6A, 6B:
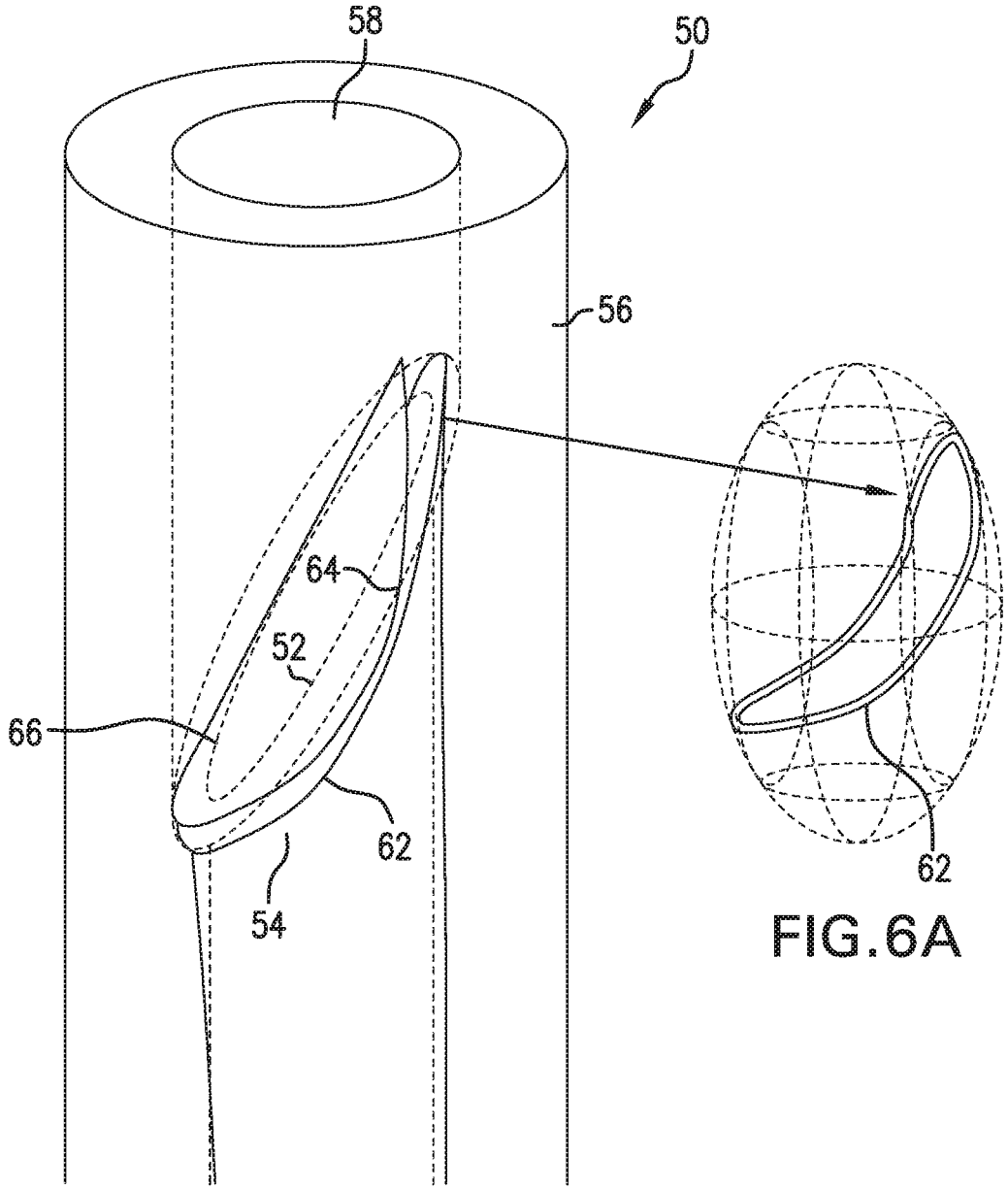
FIGS. 6A and 6B (collectively referred to as "FIG. 6") depict the valve assembly of FIG. 5 in a closed position.

FIGS. 5 and 6 depict an embodiment of the valve assembly 50 in the open and closed positions. FIG. 5 shows the valve assembly 50 in an open position, with FIG. 5A being an axial or top view from a location upstream the valve assembly 50, and FIG. 5B being a side view. In one embodiment, as shown in FIG. 5, both the valve seat 54 and the valve member 52 are disposed entirely within the fluid conduit of the mandrel 56. In this embodiment, the valve seat 54 includes or defines a curved and inclined engagement surface 62. Also, in this embodiment, the engagement surface 62 is a substantially annular surface that extends circumferentially around the fluid conduit with the exception of a pivot component (such as a pivot pin or hinge) that operably connects the valve member 52 to the valve seat 54. The valve assembly thus can be considered a flapper valve.

The valve member 52 shown in FIG. 5 is a semi-cylindrical member that has an engagement feature or surface 64 that is shaped and sized to conform to the valve seat engagement surface 62. For example, the valve member 52 includes a curved engagement surface 64 that follows the same or a similar path in the A-L plane as the valve seat engagement surface 62. As shown in FIG. 6, when in the closed position, the valve member engagement surface 62 is disposed in contact with the valve seat engagement surface 64 (or at least proximate to the engagement surface 64) to completely or substantially block fluid flow.

The valve member 52 and the valve seat 54 may be engaged by direct contact between the valve member 52 and the valve seat 54 (without any intervening material or component). Alternatively, a material such as a rubber, metal or elastomeric seal may be attached or otherwise connected to the engagement surfaces to facilitate the obstruction of fluid flow.

As is demonstrated in FIGS. 5 and 6, the valve member 52 includes a surface 66 that opposes the engagement surface 64 and is exposed to fluid flow from upstream the valve assembly 50 when the valve assembly 50 is closed (or in an intermediate position). The opposing surface may also define an inclined or curved shape. For example, as shown in FIG. 6, when the valve member 52 is in the closed position, the opposing surface 66 is inclined in the plane defined by axes A and L. This inclined surface may be beneficial in reducing or redirecting the force applied by borehole fluid, thereby permitting higher pressures to be applied as compared to conventional valve assemblies. The opposing surface 66 may define any suitable shaped when closed, including an inclined shape as shown in FIGS. 5 and 6, a curved shape, a dome shape, a conical shape, a pyramid shape and others.

In the above embodiments, the valve seat 54 is stationary while the valve member 52 is moveable. The embodiments are not so limited, as both the valve seat 54 and the valve member 52 may be moveable, or the valve member 52 may be stationary while the valve seat is moveable.

Figure 7A:
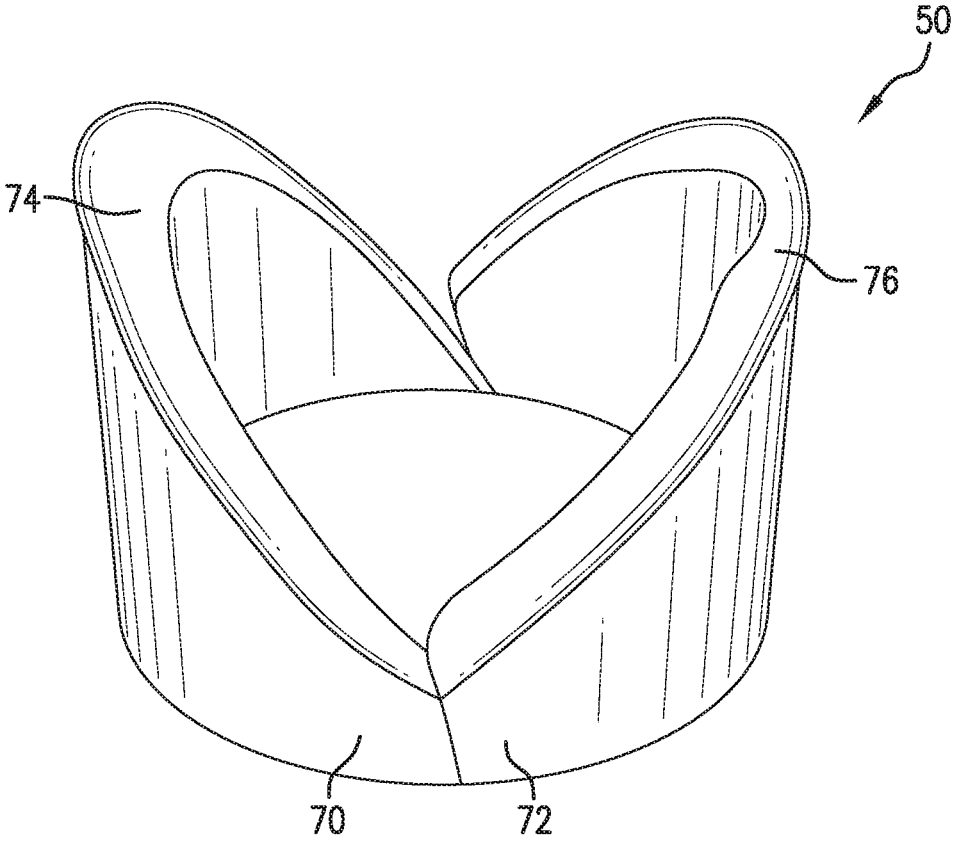
FIGS. 7A and 7B (collectively referred to as "FIG. 7") depict a side view and an axial view, respectively, of an embodiment of a valve assembly in an open position, the valve assembly including opposing moveable valve components.
Figure 7B:
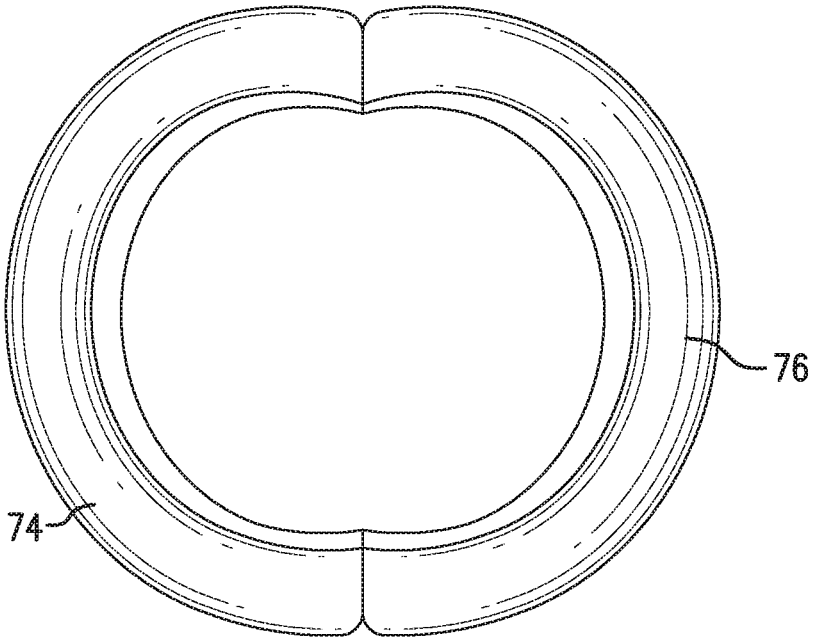
Figure 8:
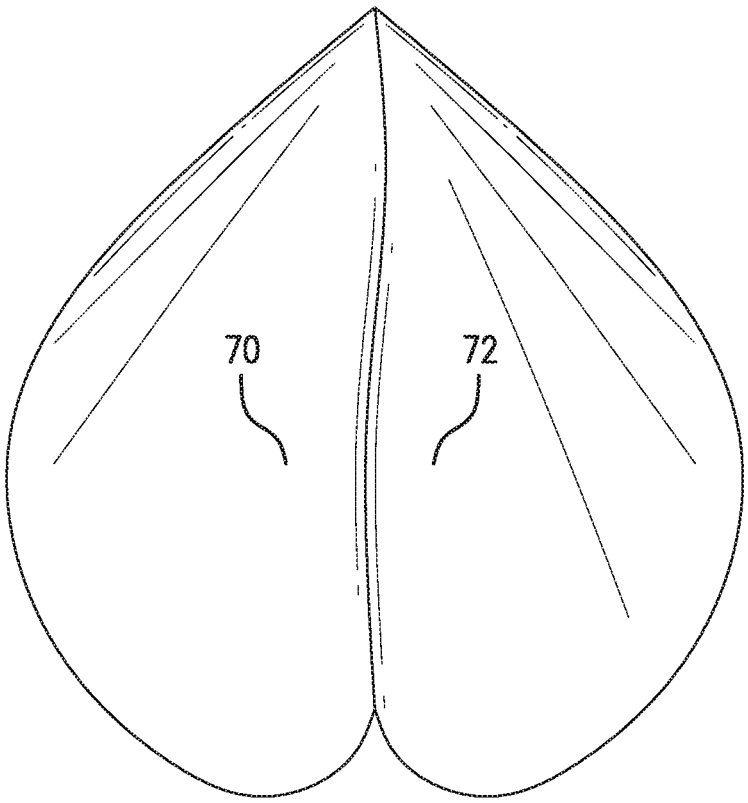
FIG. 8 depicts the valve assembly of FIG. 7 in a closed position.

FIGS. 7 and 8 depict an embodiment of the valve assembly 50, in which both the valve member 52 and the valve seat 54 are moveable. In this embodiment, the valve assembly 50 includes moveable valve components 70 and 72, which are engageable with each other to cut off or otherwise restrict fluid flow. The valve components 70 and 72 may be configured as part of a flapper valve assembly or other type of valve assembly. The valve components 70 and 72 may both be considered valve members. Alternatively, the valve component 70 may be considered a valve member 52 and the valve component 72 may be considered as a valve seat 54, or vice versa.

FIG. 7 shows the valve assembly 50 in an open position, in which the valve components 70 and 72 are separated to permit fluid flow therethrough. In the closed position, shown in FIG. 8, the valve components form a conical exposed surface. The valve components may be configured to form any desired shape of the exposed surface (e.g., a dome shape) to facilitate blocking fluid and resisting fluid pressure when closed.

The valve assembly 50 may be used in conjunction with various methods that include performing a subterranean operation. The valve assembly 50 may be incorporated into various components and tools, such as frac plugs, bridge plugs, isolation valves, safety valves, floating liners and any other components that facilitate fluid control downhole.

The following is an example of a method of performing a subterranean operation that includes the use of a tool or component having a valve assembly or assemblies as described herein. The method in this example is a method of stimulating a formation or other subterranean region. Aspects of the method, or functions or operations performed in conjunction with the method, may be performed by one or more processing devices, such as the surface processing unit 30, either alone or in conjunction with a human operator.

The method includes one or more of the following steps or stages, all of which may be performed in the order described. However, certain stages may be omitted, stages may be added, or the order of the stages changed.

In the first stage, one or more downhole components, such as the completion and/or stimulation assembly 18, are deployed into a borehole. The assembly 18 includes at least one packer assembly 40 and at least one valve assembly 50 that forms part of a frac plug. The assembly 18 may include additional components or tools, such as perforating guns or frac sleeves for stimulation. The frac plug is configured to be set in place by, for example, actuating one or more slips and/or expanding a packer element (e.g., a packer element in the packer assembly or a packer element incorporated into the frac plug).

In the second stage, the packer assembly 40 is set to establish a production zone along the borehole, and the frac plug is set. This may be accomplished using the setting tool 22 or other suitable mechanism. In the third stage, perforations and/or fractures are generated at the borehole via the perforating guns and/or by injecting fluid at a high pressure through a frac sleeve. For example, the valve assembly 50 is actuated (e.g., by hydraulic or electrical actuation) to move the valve member 52 to the closed position and isolate a length of the borehole above the frac plug, and fluid is pressurized to fracture a formation region.

In the fourth stage, further stimulation may be performed to, for example, create fractures and/or extend fractures created in the third stage. In this stage, the valve assembly 50 is closed and a length of the borehole is pressurized. In the fifth stage, fluid flow may be restored by re-opening the valve assembly 50 or milling through the frac plug.

Set forth below are some embodiments of the foregoing disclosure:

Embodiment 1: A device for controlling fluid flow in a borehole, comprising: a support structure including a fluid conduit, the fluid conduit defining a flow path having a longitudinal axis; a valve seat connected to the support structure and disposed within the fluid conduit, the valve seat defining a first engagement surface and having an opening configured to permit fluid flow through the fluid conduit, the first engagement surface having an inclined shape, the inclined shape defining an angle with respect to the longitudinal axis; and a valve member disposed within the fluid conduit, the valve member configured to be actuated to move the valve member between an open position and a closed position, the valve member engaging the first engagement surface to restrict the fluid flow when in the closed position.

Embodiment 2: The device of any prior embodiment, wherein the first engagement surface includes at least one of a straight surface and a curved surface.

Embodiment 3: The device of any prior embodiment, wherein the first engagement surface defines an acute angle with respect to the longitudinal axis.

Embodiment 4: The device of any prior embodiment, wherein the valve member includes at least a second engagement surface, the second engagement configured to conform to the inclined shape of the first engagement surface.

Embodiment 5: The device of any prior embodiment, wherein the valve member includes an opposing surface, the opposing surface exposed to the fluid flow and defining an inclined surface when in the closed position.

Embodiment 6: The device of any prior embodiment, wherein the valve seat is a moveable component.

Embodiment 7: The device of any prior embodiment, wherein the valve member is pivotable about a first pivot point, and the valve seat is pivotable about a second pivot point.

Embodiment 8: The device of any prior embodiment, wherein the valve member and the valve seat define at least one of a conical shape and a dome shape when in the closed position.

Embodiment 9: The device of any prior embodiment, wherein the valve member is a flapper valve member.

Embodiment 10: The device of any prior embodiment, wherein the support structure is part of a plug or a packer configured to be deployed in the borehole, the valve member moveable to the closed position to restrict the fluid flow and permit borehole pressure to be applied to stimulate a subterranean region.

Embodiment 11: A method of controlling fluid flow in a borehole, comprising: deploying a fluid control device in a borehole, the fluid control device including a support structure having a fluid conduit that defines a flow path having a longitudinal axis, a valve seat disposed within the fluid conduit and connected to the support structure, and a valve member disposed within the fluid conduit and configured to be actuated to move the valve member between an open position and a closed position, the valve seat defining a first engagement surface and having an opening configured to permit fluid flow through the fluid conduit, the first engagement surface having an inclined shape, the inclined shape defining an angle with respect to the longitudinal axis; and controlling fluid flow through the fluid conduit by moving the valve member from the open position to the closed position and engaging the valve member with the first engagement surface to restrict the fluid flow.

Embodiment 12: The method of any prior embodiment, wherein the first engagement surface includes at least one of a straight surface and a curved surface.

Embodiment 13: The method of any prior embodiment, wherein the first engagement surface defines an acute angle with respect to the longitudinal axis.

Embodiment 14: The method of any prior embodiment, wherein the valve member includes at least a second engagement surface, the second engagement configured to conform to the inclined shape of the first engagement surface.

Embodiment 15: The method of any prior embodiment, wherein the valve member includes an opposing surface, the opposing surface exposed to the fluid flow and defining an inclined surface when in the closed position.

Embodiment 16: The method of any prior embodiment, wherein controlling the fluid flow includes moving both the valve seat and the valve member into engagement with each other to restrict the fluid flow.

Embodiment 17: The method of any prior embodiment, wherein moving the valve seat and the valve member including pivoting the valve member about a first pivot point, and pivoting the valve seat about a second pivot point.

Embodiment 18: The method of any prior embodiment, wherein the valve member and the valve seat define at least one of a conical shape and a dome shape when in the closed position.

Embodiment 19: The method of any prior embodiment, wherein the valve member is a flapper valve member.

Embodiment 20: The method of any prior embodiment, wherein the support structure is part of a plug or a packer configured to be deployed in the borehole, the valve member moveable to the closed position to restrict the fluid flow and permit borehole pressure to be applied to stimulate a subterranean region.

In support of the teachings herein, various analysis components may be used, including a digital and/or an analog system. For example, embodiments such as the system 10, downhole tools, hosts and network devices described herein may include digital and/or analog systems. Embodiments may have components such as a processor, storage media, memory, input, output, wired communications link, user interfaces, software programs, signal processors (digital or analog), signal amplifiers, signal attenuators, signal converters and other such components (such as resistors, capacitors, inductors and others) to provide for operation and analyses of the apparatus and methods disclosed herein in any of several manners well-appreciated in the art. It is considered that these teachings may be implemented in conjunction with a set of computer executable instructions stored on a non-transitory computer readable medium, including memory (ROMs, RAMs), optical (CD-ROMs), or magnetic (disks, hard drives), or any other type that when executed causes a computer to implement the method of the present invention. These instructions may provide for equipment operation, control, data collection and analysis and other functions deemed relevant by a system designer, owner, user or other such personnel, in addition to the functions described in this disclosure.

Elements of the embodiments have been introduced with either the articles "a" or "an." The articles are intended to mean that there are one or more of the elements. The terms "including" and "having" are intended to be inclusive such that there may be additional elements other than the elements listed. The conjunction "or" when used with a list of at least two terms is intended to mean any term or combination of terms. The terms "first," "second" and the like do not denote a particular order, but are used to distinguish different elements.

While the invention has been described with reference to exemplary embodiments, it will be understood that various changes may be made and equivalents may be substituted for elements thereof without departing from the scope of the invention. In addition, many modifications will be appreciated to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A device for controlling fluid flow in a borehole, comprising:

a support structure including a fluid conduit, the fluid conduit defining a flow path having a longitudinal axis;

a valve seat connected to the support structure and disposed within the fluid conduit, the valve seat defining a first engagement surface and having an opening configured to permit fluid flow through the fluid conduit, the first engagement surface having an inclined shape, the inclined shape defining an angle with respect to the longitudinal axis; and a valve member disposed within the fluid conduit, the valve member configured to be actuated to move the valve member between an open position and a closed position, the valve member engaging the first engagement surface to restrict the fluid flow when in the closed position, at least one of the valve seat and the valve member forming a conical shape having an exposed surface that is exposed to the fluid flow when the valve member in the closed position.

2. The device of claim 1, wherein the first engagement surface includes at least one of a straight surface and a curved surface.

3. The device of claim 1, wherein the first engagement surface defines an acute angle with respect to the longitudinal axis.

4. The device of claim 1, wherein the valve member includes at least a second engagement surface, the second engagement configured to conform to the inclined shape of the first engagement surface.

5. The device of claim 1, wherein the valve member includes an opposing surface that forms at least part of the exposed surface, the opposing surface exposed to the fluid flow and defining an inclined surface when in the closed position.

6. The device of claim 1, wherein the valve seat is a moveable component.

7. The device of claim 6, wherein the valve member is pivotable about a first pivot point, and the valve seat is pivotable about a second pivot point.

8. The device of claim 7, wherein the valve member and the valve seat define a conical shape when in the closed position.

9. The device of claim 1, wherein the valve member is a flapper valve member.

10. The device of claim 1, wherein the support structure is part of a plug or a packer configured to be deployed in the borehole, the valve member moveable to the closed position to restrict the fluid flow and permit borehole pressure to be applied to stimulate a subterranean region.

11. A method of controlling fluid flow in a borehole, comprising:

deploying a fluid control device in a borehole, the fluid control device including a support structure having a fluid conduit that defines a flow path having a longitudinal axis, a valve seat disposed within the fluid conduit and connected to the support structure, and a valve member disposed within the fluid conduit and configured to be actuated to move the valve member between an open position and a closed position, the valve seat defining a first engagement surface and having an opening configured to permit fluid flow through the fluid conduit, the first engagement surface having an inclined shape, the inclined shape defining an angle with respect to the longitudinal axis, at least one of the valve seat and the valve member forming a conical shape having an exposed surface that is exposed to the fluid flow when the valve member is in the closed position; and controlling fluid flow through the fluid conduit by moving the valve member from the open position to the closed position and engaging the valve member with the first engagement surface to restrict the fluid flow.

12. The method of claim 11, wherein the first engagement surface includes at least one of a straight surface and a curved surface.

13. The method of claim 11, wherein the first engagement surface defines an acute angle with respect to the longitudinal axis.

14. The method of claim 11, wherein the valve member includes at least a second engagement surface, the second engagement configured to conform to the inclined shape of the first engagement surface.

15. The method of claim 11, wherein the valve member includes an opposing surface that forms at least part of the exposed surface, the opposing surface exposed to the fluid flow and defining an inclined surface when in the closed position.

16. The method of claim 11, wherein controlling the fluid flow includes moving both the valve seat and the valve member into engagement with each other to restrict the fluid flow.

17. The method of claim 16, wherein moving the valve seat and the valve member including pivoting the valve member about a first pivot point, and pivoting the valve seat about a second pivot point.

18. The method of claim 17, wherein the valve member and the valve seat define a conical shape when in the closed position.

19. The method of claim 11, wherein the valve member is a flapper valve member.

20. The method of claim 11, wherein the support structure is part of a plug or a packer configured to be deployed in the borehole, the valve member moveable to the closed position to restrict the fluid flow and permit borehole pressure to be applied to stimulate a subterranean region.

* * * * *